US005566549A

United States Patent [19]

Clarke

[11] Patent Number: 5,566,549

[45] Date of Patent: Oct. 22, 1996

[54] IN-LINE ENGINES HAVING RESIDUAL CYCLES AND METHOD OF OPERATION

[75] Inventor: John M. Clarke, Chillicothe, Ill.

[73] Assignee: Caterpillar Inc., Peoria, Ill.

[21] Appl. No.: 464,184

[22] Filed: Jun. 5, 1995

[51] Int. Cl.[6] ..... F02G 3/02

[52] U.S. Cl. ..... 60/620

[58] Field of Search ..... 60/620, 622

[56] References Cited

U.S. PATENT DOCUMENTS

| | | | |
|---|---|---|---|
| 2,255,925 | 9/1941 | Heylandt | 60/620 |
| 2,267,461 | 12/1941 | Heylandt | 60/620 |
| 2,280,487 | 4/1942 | Heylandt . | |
| 3,143,850 | 8/1964 | Foster . | |
| 3,267,661 | 8/1966 | Petrie . | |
| 3,608,307 | 5/1969 | Strom . | |
| 4,074,533 | 2/1978 | Stockton | 60/620 |
| 4,159,699 | 7/1979 | McCrum . | |
| 5,072,589 | 12/1991 | Schmitz | 60/622 |

FOREIGN PATENT DOCUMENTS

| | | | |
|---|---|---|---|
| 717771 | 2/1942 | Germany | 60/620 |
| 2402682 | 7/1974 | Germany | 60/620 |

*Primary Examiner*—Michael Koczo

*Attorney, Agent, or Firm*—Frank L. Hart; Alan J. Hickman

[57] ABSTRACT

Apparatus and a method control the passage of gases into and from a combustion cylinder of an engine. Each combustion cylinder of the engine is associated with a respective induction-compression and an exhaust-expansion cylinder and the compressed gases of these cylinders are controllably passed at preselected intervals from one cylinder to the next.

8 Claims, 3 Drawing Sheets

IN-LINE ENGINES HAVING RESIDUAL CYCLES AND METHOD OF OPERATION

TECHNICAL FIELD

The present invention resides in a method and apparatus for controlling gases into and from a combustion cylinder of an in-line engine.

BACKGROUND ART

Various schemes have heretofore been conceived for controlling the gases into and from a combustion cylinder of an engine. A multiplicity of variables during the control of gases to the engine produce significant engine operating efficiencies.

Some of the desired results of the control of these gases are longer useful combustion time at a preselected engine speed, larger quantities of exhaust retention with high temperatures for ignition, low emissions and high efficiencies. The method and apparatus of this invention are directed to achieve one or more of the desired results of engine gas control.

DISCLOSURE OF THE INVENTION

In one aspect of the invention, a method is provided for controlling gases into and from a combustion cylinder of an engine having an induction-compression cylinder and an exhaust-expansion cylinder associated and in fluid communication with the combustion cylinder. An induction-compression cylinder piston, exhaust-expansion cylinder piston and combustion cylinder piston are each connected to a respective crank throw of the engine drive shaft at respective circumferentially spaced locations in the range of about 90 to about 120 degrees one from the others. Air is passed into the induction- compression chamber from about TDC of this cylinder to about its BDC. Compressed air from the induction-compression cylinder is passed into the combustion cylinder from about 60 degrees before TDC of the induction-compression cylinder piston when the combustion cylinder is at about BDC. The passing of compressed air is terminated at about TDC of the induction-compression cylinder piston when the combustion cylinder piston is at about 60 degrees after BDC. Exhaust gasses from the combustion cylinder are passed into the exhaust-expansion cylinder from about 60 degrees before BDC of the combustion cylinder piston when the exhaust-expansion cylinder piston is at about TDC. The passing of exhaust gases is terminated at about BDC of the combustion cylinder when the exhaust-expansion cylinder piston is at about 60 degrees after TDC.

In another aspect of the invention, an engine has a plurality of combustion cylinder piston each connected to a respective crank throw of the engine crank shaft. A plurality of induction compression, combustion and exhaust expansion crank throws are each connected to the crank shaft and circumferentially positioned in the range of about 90 to about 120 degrees from respective associated crank throws. A plurality of induction compression cylinder piston are each connected to a respective induction compression crank throw. A plurality of exhaust-expansion pistons are each connected to a respective exhaust-expansion crank throw. An induction valve is associated with each induction-compression cylinder and is controllably moveable between a first position at which the induction-compression cylinder is open and a second position at which the induction-compression cylinder is closed. An expansion valve is associated with each exhaust-expansion cylinder and is controllably moveable between a first position at which the exhaust-expansion cylinder is open and a second position at which the exhaust-expansion cylinder piston is closed. A first fluid pathway connects the induction-compression cylinder and the combustion cylinder in fluid communication. A second fluid pathway connects the combustion cylinder and the exhaust-expansion cylinder in fluid communication. A first valve is positioned in the first fluid pathway and is adapted to initiate and terminate fluid communication from the induction-compression cylinder into the combustion cylinder. A second valve is positioned in the second fluid pathway and is adapted to initiate and terminate fluid communication from the combustion cylinder into the exhaust-expansion cylinder. A first control means is provided for opening the first valve and initiating communication at about 60 degrees before TDC of the induction-compression cylinder piston and at about BDC of the combustion cylinder and for terminating communication at about TDC of the induction-compression cylinder piston and at about 60 degrees after BDC of the combustion cylinder piston. A second control means is provided for opening the second valve and initiating communication at about 60 degrees before BDC of the combustion cylinder piston and at about TDC of the exhaust-expansion cylinder piston and for terminating communication at about BDC of the combustion cylinder piston and at about 60 degrees after TDC of the exhaust-expansion cylinder piston.

BEST MODE FOR CARRYING OUT THE INVENTION

Figure 1:
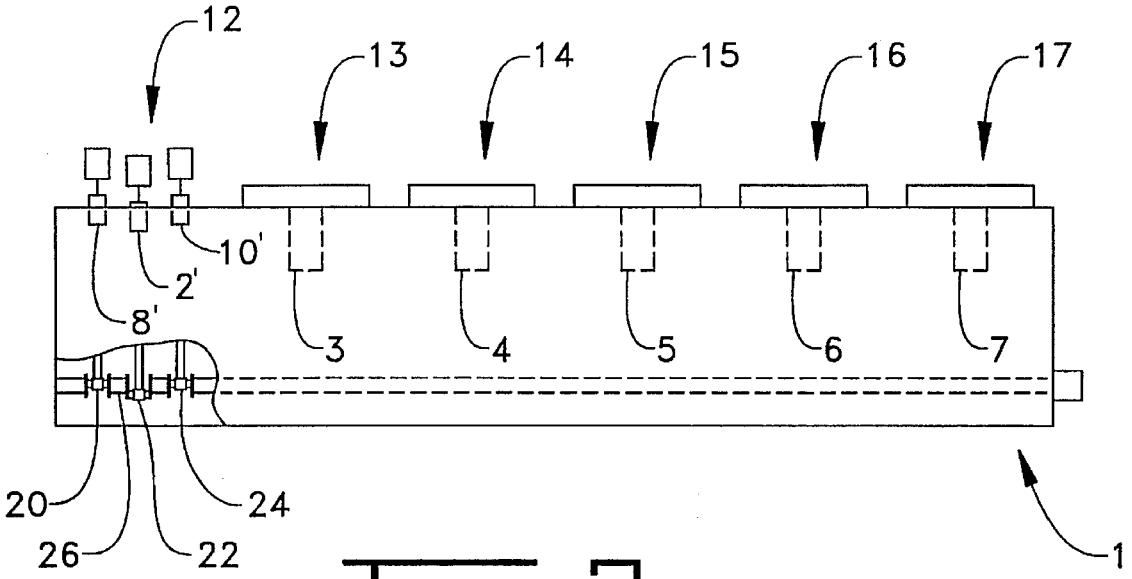
FIG. 1 is a diagrammatic view of an engine having a plurality of combustion cylinders and associated induction-compression and exhaust-expansion cylinders.
Figure 2:
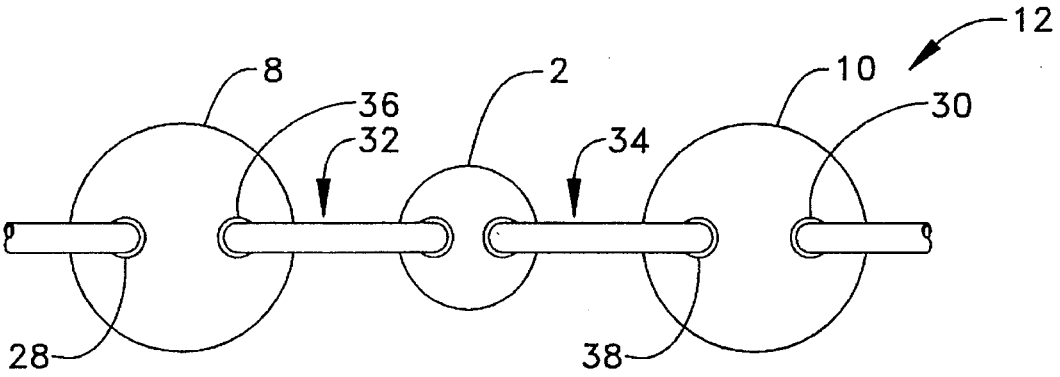
FIG. 2 is a diagrammatic view of one set of induction-compression, combustion and exhaust-expansion cylinders of the engine.

Referring to FIGS. 1 and 2, an engine 1, preferably an in-line engine, has a plurality of combustion cylinders 2–7, for example. Each combustion cylinder 2 is associated with a respective induction-compression cylinder and an exhaust-expansion cylinder 8,10. The induction-compression, combustion, and exhaust-expansion cylinders 8,2,10 form a cylinder set 12. Preferably, each engine 1 has a plurality of cylinder sets 12–17. For purposes of brevity, this invention will be described with reference to a single set of cylinders and their associated apparatus.

Figure 3:
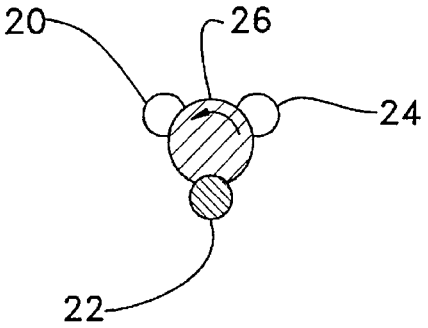
FIG. 3 is a diagrammatic view of one set of crank throws for their respective induction-compression, combustion and exhaust expansion cylinders.

Engine pistons 2', 8', 10' of the respective cylinders 2, 8, 10 of each cylinder a set are connected to a respective crank throw 20,22,24, of the engine crank shaft 26. As better shown in FIG. 3, the respective induction-compression, combustion and exhaust-expansion crank throws 20,22,24 of each cylinder set are circumferentially positioned in the range of about 90 to about 120 degrees from the respective associated crank throw of the set. Preferably for providing,a balanced system, the crank throws 20,22,24 are circumferentially spaced about 120 degrees apart with the combustion crank throw 22 being positioned about 120 degrees from both the induction crank throw 20 and the expansion crank throw 24 of the respective set. The induction-compression cylinder piston 8' is connected to the induction crank throw 20, the combustion cylinder piston 2' is connected to the combustion crank throw 22 and the exhaust-expansion cylinder piston 10' is connected to the expansion crank throw 24 by an apparatus as is well known in the art.

Figure 4:
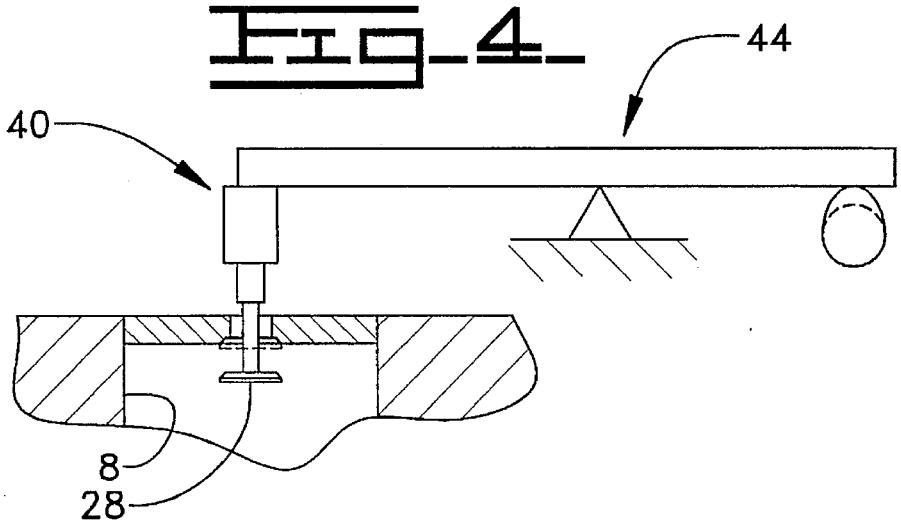
FIG. 4 is a diagrammatic view of one control means that can be utilized with this invention.
Figure 5:
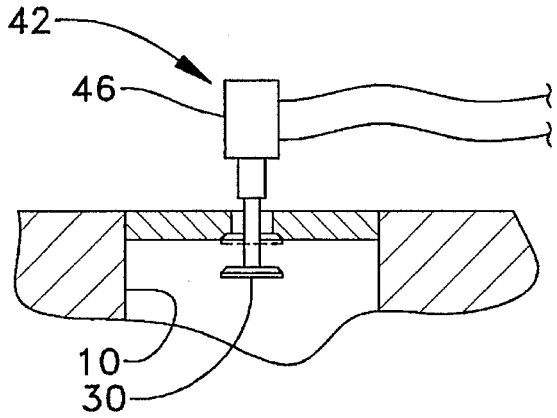
FIG. 5 is a diagrammatic view of another control means that can be utilized with this invention.

Referring also to FIG. 4, an induction valve 28 is associated with the inductions-compression cylinder 8 and is controllably moveable between a first position, shown by solid lines, at which the induction cylinder 8 is open to the atmosphere and a second position, shown by broken lines, at which the induction-compression cylinder is closed. Referring to FIG. 5, an expansion valve 30, is associated with the exhaust-expansion cylinder 10 and is controllably moveable between a first position, as shown by solid lines in FIG. 5, at which the exhaust-expansion cylinder 10 is open to the atmosphere, a turbocharger, or both and a second position, shown by broken lines, at which the exhaust-expansion cylinder 10 is closed.

As better seen in FIG. 2, a first fluid pathway 32 connects the induction-compression cylinder 8 and the combustion cylinder 2 in fluid communication. A second fluid pathway 34 connects the combustion cylinder 2 and the exhaust-expansion cylinder 10 in fluid communication.

A first valve 36 is positioned in the first fluid pathway 32 and is adapted to controllably initiate and terminate fluid communication from the induction-compression cylinder 8 into the combustion cylinder 2. A second valve 38 is positioned in the second fluid pathway 34 and adapted to initiate and terminate fluid communication from the combustion cylinder 2 into the exhaust-expansion cylinder 10.

A first control means 40 (FIG. 4) is provided for opening the first valve 36 and initiating communication at about 60 degrees before top dead center (TDC) of the induction-compression cylinder piston 8' and about at bottom dead center (BDC) of the combustion cylinder piston 2 and for terminating communication at about TDC of the induction-compression cylinder piston 8' and about 60 degrees after BDC of the combustion cylinder piston 2. A second control means 42 (FIG. 5) is provided for opening the second valve 38 and initiating communication at about 60 degrees before BDC of the combustion cylinder piston 2' and at about TDC of the exhaust-expansion cylinder piston 10' and for terminating communication at about BDC of the combustion cylinder piston 2' and about 60 degrees after TDC of the exhaust-expansion cylinder piston 10'.

Figure 6:
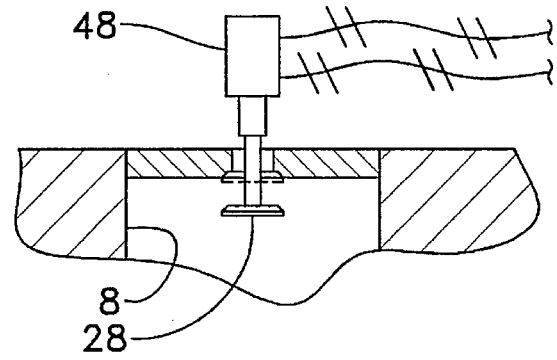
FIG. 6 is a diagrammatic view of yet another control means that can be utilized with this invention.

Referring to FIGS. 4–6, the first and second control means 40,42 preferably include a rocker arm-cam system 44 as shown in FIG. 4 and as well known in the art. There can also be a first and second valves positioned at each end of the fluid pathways 32,34. These control means 40,42 can however be a hydraulically actuated cylinder 46, as shown in FIG. 5 or be an electrically actuated solenoid 48, as shown in FIG. 6, without departing from this invention. Such systems are well known in the art and preferably are associated with respective valves 28,30,36,38 of the induction-compression and exhaust-expansion cylinders 8,10. It should be understood however, that the valves 36,38 can be positioned at any location within their respective fluid pathways 32,34 without departing from this invention.

INDUSTRIAL APPLICABILITY

In the method of this invention, gases passing into and from the combustion cylinder are controlled to provide enhanced operating parameters. Fresh air is passed into the induction-compression chamber from about TDC of the induction-compression cylinder piston 8' to about BDC of the induction-compression cylinder piston 8'. As the induction-compression cylinder piston 8' moves upwardly, the fresh air in the induction-compression cylinder piston 8' is compressed. The compressed air from the induction-compression cylinder piston 8' is passed into the combustion cylinder from about 60 degrees before TDC of the induction-compression cylinder piston 8' when the combustion cylinder piston 2' is at about BDC. As set forth above and as can be noted by a study of FIG. 7, the induction-compression cylinder piston 8', combustion cylinder piston 2' and exhaust-expansion cylinder 10 are functioning about 120 degrees off-set from one another for providing the timing thereof.

At about TDC of the induction-compression cylinder piston 8', the passing of compressed air is terminated and the combustion cylinder piston 2 is at about 60 degrees after BDC and therefore the gases in the combustion cylinder continue to be compressed, fuel is injected and the cylinder fires at about TDC. Exhaust gases from the combustion cylinder piston 2' are passed into the exhaust-expansion cylinder piston 10' from about 60 degrees before BDC of the combustion cylinder piston 2' when the exhaust-expansion cylinder is at about TDC. This passing of exhaust gases is terminated at about BDC of the combustion cylinder piston 2' when the exhaust-expansion cylinder piston 10' is at about 60 degrees after TDC.

Figure 7:
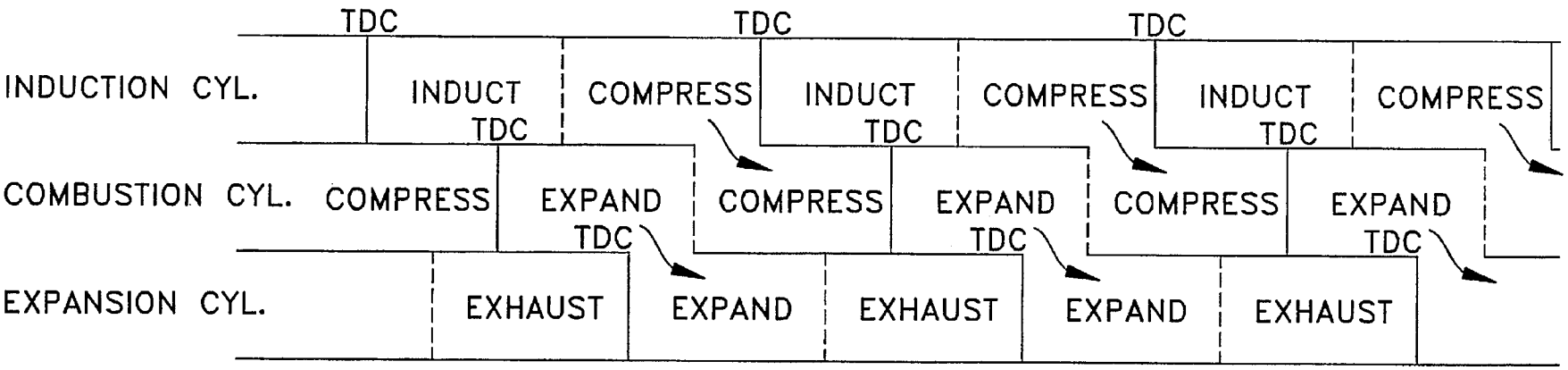
FIG. 7 is graphic view of the sequence of operation of the cylinders and associated valves of this invention.

A study of FIG. 7 will assist in the understanding of the valving sequence in producing the controlled passage of gases. This invention therefore is an application of a dual-compression, dual-expansion, high exhaust-retention two stroke cycle in an engine configuration which is preferred for heavy duty engines. This makes possible the use of higher compression ratios because the combustion chamber is compact. Longer useful combustion time is achieved at a preselected engine speed because the combustion chamber has a relatively low geometric compression ratio. The retention of large quantities of exhaust with high temperatures is also provided for assisting ignition. Such properties provided by this invention result an a high efficient, low emission engine.

Other aspects, objects and advantages of this invention can be obtained from a study of the drawings, the disclosure and the appended claims.

I claim:

1. A method of controlling gases into and from a combustion cylinder of an engine having an induction-compression cylinder and an exhaust-expansion cylinder associated and in fluid communication with the combustion cylinder, said cylinders each having a piston and each piston being connected to a respective crank throw of the engine drive shaft at respective circumferentially spaced locations in the range of between 90 and 120 degrees one from the others, comprising:

passing air into the induction-compression chamber from about TDC of the piston of the induction-compression cylinder to about BDC of said piston of the induction-compression cylinder;

passing compressed air from the induction-compression cylinder into the combustion cylinder from about 60 degrees before TDC of the piston of the induction-compression cylinder when the piston of the combustion cylinder is at about BDC;

terminating said passing of compressed air at about TDC of the piston of the induction-compression cylinder when the piston of the combustion cylinder is at about 60 degrees after BDC;

passing exhaust gasses from the combustion cylinder into the exhaust-expansion cylinder from about 60 degrees before BDC of the piston of the combustion cylinder when the piston of the exhaust-expansion cylinder is at about TDC; and terminating said passing of exhaust gases at about BDC of the piston of the combustion cylinder when the piston of the exhaust-expansion cylinder is at about 60 degrees after TDC.

2. A method, as set forth in claim 1, wherein the respective crank throws of the engine driver shaft are positioned at circumferentially spaced locations of about 120 degrees one from adjacent others.

3. A method, as set forth in claim 1, wherein exhaust gasses are discharged from the expansion cylinders during the compression stroke of the piston of the exhaust-expansion cylinders.

4. An engine having a plurality of combustion, induction-compression and exhaust-expansion cylinders and a plurality of combustion cylinder pistons each connected to a respective crank throw of the engine crank shaft, comprising:

a plurality of induction crank throws each connected to the engine crank shaft;

a plurality of expansion crank throws each connected to the engine crank shaft, said combustion, induction and expansion crank throws each being circumferentially positioned in the range of between 90 and 120 degrees from adjacent associated crank throws;

a plurality of induction-compression cylinder pistons each connected to a respective induction crank throw;

a plurality of exhaust-expansion cylinder pistons each connected to a respective expansion crank throw;

an induction valve associated with each induction-compression cylinder and being controllably moveable between a first position at which the induction-compression cylinder is open to the atmosphere and a second position at which the induction-compression cylinder is closed to the atmosphere;

an expansion valve associated with each exhaust-expansion cylinder and being controllably moveable between a first position at which the exhaust-expansion cylinder is open and a second position at which the expansion cylinder is closed;

a first fluid pathway connecting the induction-compression cylinder and the combustion cylinder in fluid communication;

a second fluid pathway connecting the combustion cylinder and the exhaust-expansion cylinder in fluid communication;

a first valve positioned in the first fluid pathway and being adapted to initiate and terminate fluid communication from the induction-compression cylinder into the combustion cylinder;

a second valve positioned in the second fluid pathway and being adapted to initiate and terminate fluid communication from the combustion cylinder into the exhaust-expansion cylinder;

a first control means for opening the first valve and initiating communication at about 60 degrees before TDC of the induction-compression cylinder piston and about at BDC of the combustion cylinder piston and for terminating communication at about TDC of the induction-compression cylinder piston and about 60 degrees after BDC of the combustion cylinder piston; and a second control means for opening the second valve and initiating communication at about 60 degrees before BDC of the combustion cylinder piston and at about TDC of the exhaust-expansion cylinder piston and for terminating communication at about BDC of the combustion cylinder piston and about 60 degrees after TDC of the exhaust-expansion cylinder piston.

5. An engine, as set forth in claim 4, wherein the crank throws of each induction-compression cylinder of a cylinder set, said cylinder set defined by a induction-compression cylinder, a combustion cylinder, and an exhaust-expansion cylinder, is positioned about 120 degrees from the crank throw of the combustion cylinder and the crank throw of the exhaust-expansion cylinder is positioned about 120 degrees from the crank throw of the combustion cylinder and about 240 degrees from the respective crank throw of the induction-compression cylinder.

6. An in-line engine, as set forth in claim 4, wherein the first and second means include respective rocker arms and cam systems.

7. An in-line engine, as set forth in claim 4, wherein the first and second means includes hydraulically actuated cylinders.

8. An in-line engine, as set forth in claim 4, wherein the first and second means includes electrically actuated solenoids.

* * * * *